US005131135A

United States Patent [19]

Gronau

[11] Patent Number: 5,131,135

[45] Date of Patent: Jul. 21, 1992

[54] WIRE-REMOVING DEVICE FOR UNITS

[75] Inventor: Kurt Gronau, Euskirchen, Fed. Rep. of Germany

[73] Assignee: B+G-Fördertechnik GmbH, Fed. Rep. of Germany

[21] Appl. No.: 671,874

[22] PCT Filed: Apr. 19, 1990

[86] PCT No.: PCT/DE90/00294

§ 371 Date: Apr. 10, 1991

§ 102(e) Date: Apr. 10, 1991

[87] PCT Pub. No.: WO90/14994

PCT Pub. Date: Dec. 13, 1990

[30] Foreign Application Priority Data

May 30, 1989 [DE] Fed. Rep. of Germany ... 8906616[U]

[51] Int. Cl.[5] ..... B23P 19/00; B26D 9/00

[52] U.S. Cl. ..... 29/564.3; 29/426.4; 83/909

[58] Field of Search ..... 29/33 R, 564.1, 564.3, 29/566.1, 426.4, 426.3, 56.5; 83/909, 349

[56] References Cited

U.S. PATENT DOCUMENTS

| | | | |
|---|---|---|---|
| 3,513,522 | 5/1970 | Thomson | 29/56.5 |
| 3,643,313 | 2/1972 | Dickinson | 29/56.5 |
| 4,404,723 | 9/1983 | Ohba et al. | 29/33.52 |
| 4,437,223 | 3/1984 | Petros | 29/564.3 |
| 4,553,312 | 11/1985 | Mitzel et al. | 83/909 X |
| 4,660,818 | 4/1987 | Conner et al. | 29/33.52 |
| 4,718,157 | 1/1988 | Keyzers et al. | 29/426.4 |
| 4,841,619 | 6/1989 | Theriault | 29/426.3 |
| 4,850,087 | 7/1989 | Gronau | 29/33 R |
| 4,995,784 | 2/1991 | Boisseau | 83/909 X |

FOREIGN PATENT DOCUMENTS

| | | | |
|---|---|---|---|
| 2002089 | 7/1971 | Fed. Rep. of Germany | 29/33 R |
| 2184704 | 7/1987 | United Kingdom | 29/564.3 |

*Primary Examiner*—William Briggs
*Attorney, Agent, or Firm*—Diller, Ramik & Wight

[57] ABSTRACT

The invention relates to a wire-removing device for units (7) consisting of two stacks standing closely next to one another and composed of a plurality of bales (11, 12, 13) arranged one on top of the other, each unit (7) being surrounded in one plane by a bundle (15) embracing all the bales and composed of a plurality of parallel individual wires. So that the removal of wire from the units (7) can be carried out fully automatically and at the same time in order to wind the wire bundle to form a coil, there is in the lower region of the unit (7) a wire-cutting means (18) which is combined with a wire-lifting means (3) for lifting the severed wire bundle (15). Furthermore, there is a gripping means (4) which grasps the wire bundle (15) on both sides of the wire-lifting means (3) and which brings it into a predetermined extraction position. The severed wire bundle (15) is grasped by a winding means, wound to form a roll and ejected from the device.

10 Claims, 2 Drawing Sheets

WIRE-REMOVING DEVICE FOR UNITS

Figure 1:
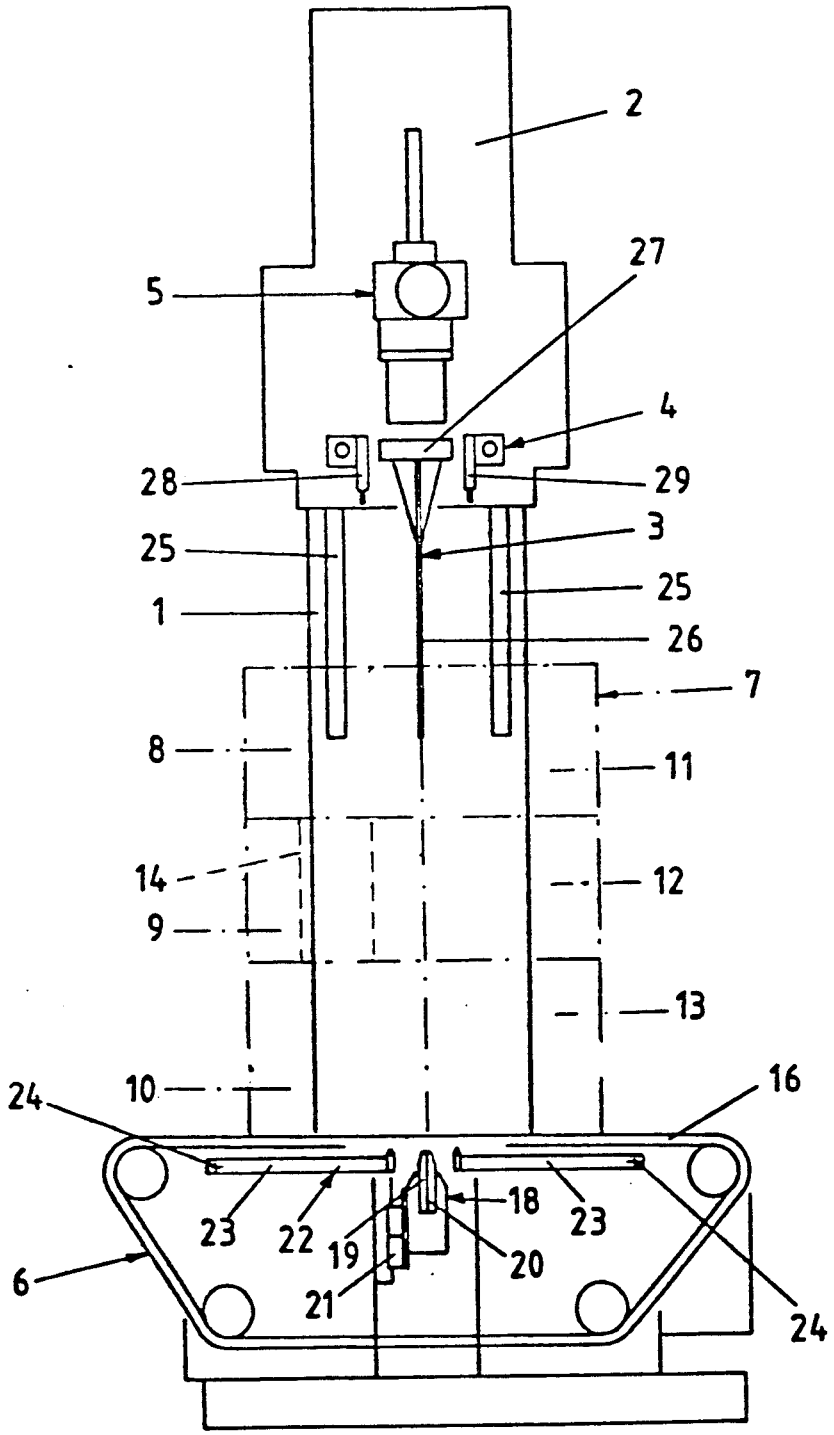

The invention relates to a wire-removing device for units consisting of two stacks standing closely next to one another and each composed of two or more bales arranged one on top of the other, each unit being surrounded in one plane by a bundle embracing all the bales and composed of a plurality of parallel individual wires.

The units normally each consist of six to eight bales, for example pulp bales or the like, each individual bale being surrounded by a plurality of tying wires. Two stacks composed of three or four bales are placed with their longer sides against one another and held together firmly by means of an encircling bundle composed of six to ten individual wires which are attached mechanically.

To remove the wire from the units, it is known to sever the bundle of individual wires by means of heavy lever cutters and to take it off by hand. The removal of wire from the individual bales can be carried out, for example, by a wire-removing machine according to German Offenlegungsschrift 3,707,966.

Not only is the removal of wire by hand dangerous for the attendance crew, but the long individual wires also have to be disposed of separately, for which purpose special winding devices for the wires are provided.

The object on which the invention is based is also to carry out the removal of wire from the units fully automatically, whilst at the same time the wire bundle will be wound to form a coil.

According to the invention, this object is achieved by means of a device which is characterised b a conveying means, by which the units can be transported into a predetermined position in the wire-removing device, by a wire-cutting means for severing the wire bundle in the lower region of the unit, by a wire-lifting means for lifting the severed wire bundle from the top side of the unit, by a gripping means which grasps the wire bundle on both sides of the wire-lifting means and which brings it into a predetermined extraction position, and by a winding means, by which the wire bundle is grasped, wound up to form a closely packed roll and ejected from the device.

The device according to the invention makes it possible to remove wire from the units fully automatically, and at the same time the wire bundle can be disposed of in a space-saving manner. The wire-lifting means guarantees that the gripping means bringing the wire bundle into a position favourable for the winding means, while being brought together, does not come in contact with the tying wires of the individual bales and does not catch on these. A fault-free working of the device is guaranteed in this way.

Preferably, there is a bale-tilting means, by which the two stacks can be so tilted away from one another at an angle that between the two stacks forms a wedge-shaped gap which starts from the top side of the unit and into which a lifting arm of the wire-lifting means can engage and lift the wire bundle from below to such an extent that it comes free from the bales and can easily be grasped by the gripping means.

The lifting arm is appropriately pivotable about a horizontal axis. Before it is used, it hangs vertically downwards, specifically in a region outside the passageway of the units. As soon as the two bale stacks have been spread apart by the bale-tilting means, the lifting arm can engage from below between the two bale stacks and lift the severed wire bundle in this region.

The conveying means preferably consists of two conveyor chains which are arranged at a distance from one another and between which there is sufficient free space. The wire-cutting means can be arranged in this free space between the conveyor chains, specifically preferably transversely relative to the conveying direction, so that the wire bundle can be severed on the underside of the unit.

The wire-cutting means appropriately consists of two elongate knife bars which are equipped on their cutting sides with teeth arranged at regular intervals and which can be pushed to and fro relative to one another. Such a wire-cutting means is known from German Patent Specification 2,816,912.

The winding means can be formed by a winding head which is movable up to the wire bundle which can be grasped by the gripping means. The winding head is movable in the vertical direction, so that it can be moved up to the wire bundle directly from above.

The bale-tilting means appropriately consists of two tilting tables which are arranged on both sides of the wire-cutting means and which can each be tilted about a horizontal axis extending transversely relative to the conveying direction of the units.

The axes of the tilting tables are appropriately each arranged on the side of the tilting tables facing away from the wire-cutting means, with the result that it is possible for the two bale stacks to be spread apart effectively.

Figure 2:
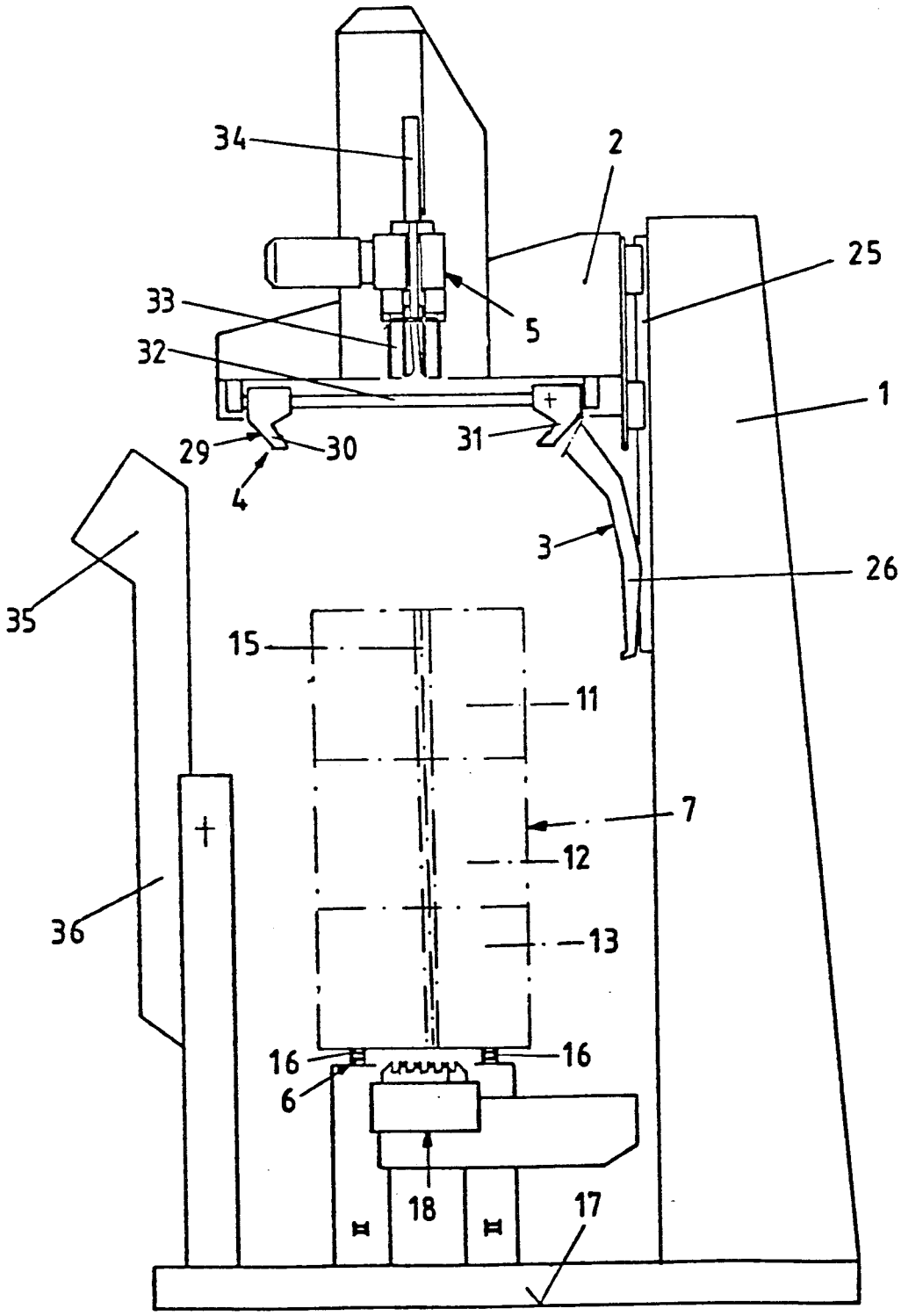

The invention is illustrated by way of example in the drawing and described in detail below with reference to the drawing. In this:

FIG. 1 shows a view of an exemplary embodiment of the wire-removing device transversely relative to the conveying direction of the units, and FIG. 2 shows a side view of the device in the conveying direction of the units.

According to the drawing, the wire-removing device consists essentially of a vertical stand 1, of a jib 2 which is mounted on this and is guided vertically displaceably on the stand 1 and which serves for receiving the wire-lifting means 3, the gripping means 4 and the winding means 5, and of a conveying means 6 by which the units 7 can be transported into a predetermined position in the wire-removing device.

The units 7, of which an example is represented in the drawing by dot-and-dash lines, consists of six individual bales 8 to 13 which are each surrounded by separate tying wires 14. The tying wires are shown on the example of the bale 9. Three bales 8, 9 and 10 or 11, 12 and 13 form respective stacks, and the two stacks are placed closely next to one another. As shown in FIG. 2, there extends round the six bales a bundle 15 composed, for example, of six or seven individual wires which hold each unit 7 firmly together and which make it easier to transport the units. For example, the units 7 can easily be lifted and handled by suspending a crane hook in the wire bundle 15.

On the conveying means 6, the units 7 are conveyed individually in succession into the wire-removing device and are transported further after the wire bundle 15 has been removed. The conveying means 6 consists of two conveyor chains 16 which are arranged at a distance from one another and which pass through a horizontal conveying section in the region of the wire-removing device at a distance above the warehouse level 17.

Arranged between the two conveyor chains 16 is a wire-cutting means 18 which consists of two elongate knife bars 19 and 20. The knife bars 19 and 20 are equipped on their cutting sides with teeth arranged at regular intervals and undercut on the meshing tooth flank and which can be pushed to and fro relative to one another. The two knife bars 19 and 20 extend exactly transversely relative to the conveying direction of the units 7.

The wire-cutting means is to sever the wire bundle 15 exactly between the two individual stacks. The particular unit therefore has to be positioned exactly above the wire-cutting means. Since the unit sizes are of differing length, the units first pass through a measuring zone in which the unit length is determined. This value is then halved automatically, and the unit then automatically stops exactly centrally above the wire-cutting means.

The wire-cutting means 18 is vertically displaceable with the aid of a slide arrangement 21, so that it can be moved out of an inactive lowered position upwards into its active cutting position after the particular unit 7 has moved into the wire-removing position. After the respective wire bundle 15 has been severed, the wire-cutting means 18 is lowered again. The unit is then moved to and fro several times over a short section, so that the severed wire bundle 15 comes loose, especially in the lower edge region, so that it can subsequently be extracted more easily.

Arranged in the region of the horizontal conveying section extending through the wire-removing device is a bale-tilting means 22, by which the two bale stacks can be spread apart from one another, so that a downwardly narrowing wedge-shaped gap starting from the top side of the unit 7 forms between the two stacks.

The bale-tilting means 22 consists of two tilting tables 23 arranged on both sides of the wire-cutting means 18. These can each be tilted about a horizontal axis 24 extending transversely relative to the conveying direction of the unit 7, the tilting axes 24 being arranged respectively on the side of the tilting tables 23 facing away from the wire-cutting means 18.

The jib 2 is located directly above the center of the horizontal conveying section of the conveying means 6. For the vertical movement of the jib 2, the latter is mounted on a vertical guide 25 which is provided on the stand 1. The drive takes place via a motor not shown in the drawing.

The wire-lifting means 3 provided on the jib 2 consists of a lifting arm 26 which is arranged exactly above the working position of the particular unit 7 and which, after the wire bundle 15 has been severed and the bale stack tilted, can engage into the wedge-shaped gap in order to lift the severed wire bundle 15. For this purpose, the lifting arm 26 is pivotable about a horizontal axis 27 lying parallel to the conveying direction of the unit 7. The pivot axle 27 of the lifting arm 26 is arranged on the jib 2 near its end mounted on the stand 1, and in its inactive position the lifting arm 26 hangs approximately vertically downwards near the stand 1. This position of the lifting arm is located outside the path of the unit 7 moving into the device. As soon as the bale-tilting means 22 is actuated, the lifting arm 26 pivots forwards into the wedge-shaped gap between the two bale stacks and lifts the upper region of the severed wire bundle 15 a little way.

In the lifted position, the wire bundle 15 can easily be grasped by the gripping means 4, without this colliding with the tying wires 14 of the individual bales.

The gripping means 4 consists of two pairs of gripping claws 28 and 29 arranged on both sides of the lifting arm 26. The claws 30 and 31 belonging to each pair of gripping claws are made hook-shaped, the hooks of the claws 30 and 31 being directed towards one another and, when in the state brought together, constitute a closed ring. The claws 30 and 31 can be moved towards and away from one another by means of a rotation-proof linear guide 32 or the like.

The winding means 5 likewise arranged on the jib 2 consists of a winding head 33 which is movable in the vertical direction relative to the jib.

When the jib 2 is lowered downwards and the lifting arm 26 has lifted the severed wire bundle, the claws 30 and 31 of each pair of gripping claws 28 and 29 move towards one another, grasp the wire bundle 15 and bring this into a position advantageous for the winding head 33. The lifting arm 26 then pivots back into its initial position, and the winding head 33 descends, grasps the wire bundle 15 and winds this up by means of its rotating inner core. After the winding of the wire bundle 15, the latter is ejected from the winding head 33 by means of an ejector piston 34. Immediately before the wire roll is ejected, the collecting basket 35, to which a chute 36 is connected, pivots under the winding head 33. The wire rolls pass via the chute 36 into a collecting container not shown in the drawing. After the disposal of the particular wire roll, the chute 36 together with the collecting basket 35 pivots once again into the inactive position, shown in FIG. 2, in which it is located outside the region of passage of the units 7.

LIST OF REFERENCE SYMBOLS

1. Stand
2. Jib
3. Wire-lifting means
4. Gripping means
5. Winding means
6. Conveying means
6. Unit
7. Bale
8. Bale
9. Bale
10. Bale
11. Bale
12. Bale
13. Tying wires (individual bales)
14. Wire bundle (unit)
16. Conveyor chains
17. Warehouse level
18. Wire-cutting means
19. Knife bar
20. Knife bar
21. Slide arrangement
22. Bale-tilting means
23. Tilting tables
24. Tilting axes
25. Vertical guide
26. Lifting arm
27. Pivot axle
28. Pair of gripping claws
29. Pair of gripping claws
30. Claw
31. Claw
32. Rotation-proof linear guide 33. Winding head
34. Ejector piston
35. Collecting basket
36. Chute

I claim:

1. Wire-removing device for units consisting of two stacks standing closely next to one another and each composed of two or more bales arranged one on top of the other, each unit being surrounded in one plane by a bundle embracing all the bales and composed of a plurality of parallel individual wires, characterised by a conveying means (6), by which the units (7) can be transported into a predetermined position in the wire-removing device, by a wire-cutting means (18) for severing the wire bundle (15) in the lower region of the unit, by a wire-lifting means (3) for lifting the severed wire bundle (15) from the top side of the unit, by a gripping means (4) which grasps the wire bundle (15) on both sides of the wire-lifting means (3) and which brings it into a predetermined extraction position, and by a winding means (5), by which the wire bundle (15) is grasped, wound to form a closely packed roll and ejected from the device.

2. Wire-removing device according to claim 1, characterised in that there is a bale-tilting means (22), by which the two stacks of bales can be so tilted away from one another at an angle that between the two stacks forms a wedge-shaped gap which starts from the top side of the unit (7), and in that the wire-lifting means (3) has a lifting arm (26) which engages into the wedge-shaped gap and which lifts the wire bundle from below.

3. Wire-removing device according to claim 2, characterised in that the lifting arm (26) is pivotable about a horizontal axis (27).

4. Wire-removing device according to claim 1, characterised in that a conveying means (6) consists of two conveyor chains (16) arranged at a distance from one another.

5. Wire-removing device according to claim 4, characterised in that the wire-cutting means (18) is arranged between the conveyor chains (16) and transversely relative to these.

6. Wire-removing device according to claim 5, characterised in that the wire-cutting means (18) has two elongate knife bars (19, 20) which are equipped on their cutting sides with teeth arranged at regular intervals and undercut on the meshing tooth flank and which can be pushed to and fro relative to one another.

7. Wire-removing device according to claim 1, characterised in that the winding means (5) is formed by a winding head (33) which can be moved up to the wire bundle (15) which can be grasped by the gripping means (4).

8. Wire-removing device according to claim 7, characterised in that the winding head (33) is movable in the vertical direction.

9. Wire-removing device according to claim 2, characterised in that the bale-tilting means (22) consists of two tables (23) which are arranged on both sides of the wire-cutting means (18) and which can each be tilted about a horizontal axis (24) extending transversely relative to the conveying direction of the units (7).

10. Wire-removing device according to claim 9, characterised in that the axes (24) of the tilting tables (23) are each arranged on the side of the tilting tables (23) facing away from the wire-cutting means (18).

* * * * *